US009240137B2

(12) United States Patent
Bapst et al.

(10) Patent No.: US 9,240,137 B2
(45) Date of Patent: Jan. 19, 2016

(54) METHOD AND APPARATUS FOR CONTENT-BASED REDUCTION OF DISPLAY POWER

(75) Inventors: Mark Bapst, South Barrington, IL (US); Julien Chaffraix, San Diego, CA (US); Su Zhao, San Diego, CA (US); Tao Xue, San Diego, CA (US); Haw-Jing Lo, San Diego, CA (US)

(73) Assignee: Qualcomm Innovation Center, Inc., San Diego, CA (US)

( * ) Notice: Subject to any disclaimer, the term of this patent is extended or adjusted under 35 U.S.C. 154(b) by 1259 days.

(21) Appl. No.: 13/023,986

(22) Filed: Feb. 9, 2011

(65) Prior Publication Data

US 2012/0200587 A1 Aug. 9, 2012

(51) Int. Cl.

*G09G 3/32* (2006.01)
*G09G 3/34* (2006.01)
*G09G 5/06* (2006.01)

(52) U.S. Cl.

CPC ..... *G09G 3/3208* (2013.01); *G09G 3/3406* (2013.01); *G09G 5/06* (2013.01); *G09G 2310/0245* (2013.01); *G09G 2310/04* (2013.01); *G09G 2320/066* (2013.01); *G09G 2320/0666* (2013.01)

(58) Field of Classification Search

CPC ... G06F 1/3265; G06F 1/3203; G06F 3/0481; G06F 17/211; G09G 2320/0626; G09G 2360/16; G09G 2320/0686; G09G 2330/021
USPC ..... 345/76, 77, 589; 715/207, 275, 776
See application file for complete search history.

(56) References Cited

U.S. PATENT DOCUMENTS 6,801,811 B2 * 10/2004 Ranganathan ..... G06F 1/3203 345/211
7,002,593 B2 * 2/2006 Milch ..... G09G 3/3208 345/211
7,614,011 B2 * 11/2009 Karidis ..... G06F 1/3203 345/212
8,091,038 B1 * 1/2012 Johnson et al. ..... 715/768
8,207,934 B2 * 6/2012 Plut ..... G06F 1/3218 345/102
8,385,987 B2 * 2/2013 Kim ..... G06F 1/1626 455/550.1
8,704,803 B2 * 4/2014 Koyama ..... G09G 3/30 345/204
8,957,886 B2 * 2/2015 You ..... G09G 3/20 345/204
9,047,835 B2 * 6/2015 Bennett ..... G06F 3/14
2003/0080967 A1 * 5/2003 Milch ..... G09G 3/3208 345/589

(Continued)

OTHER PUBLICATIONS

Dolcera Public Wiki, "OLED Mobile Phone Market Research and Analysis Report," 2011, retrieved from http://www.dolcera.com/wiki/index.php?title=OLED_Mobile_Phones_Market_Research_and_Analysis_Report.

Anandtech, "Samsung Galaxy S III—Physical Gallery", Webpage found at http://www.anandtech.com downloaded Sep. 20, 2012, May 2012, p. 4 Published in: US.

(Continued)

*Primary Examiner* — Gregory J Tryder
(74) *Attorney, Agent, or Firm* — Neugeboren O'Dowd PC

(57) ABSTRACT

Methods and devices for displaying content in a power efficient manner are disclosed. In accordance with many embodiments, content is received that includes a plurality of subcomponents, and a subcomponent with a larger surface is darkened so as to generate at least one darkened subcomponent. In addition, a contrast of selected ones of the subcomponents is adjusted so as to enable the selected ones of the subcomponents to be viewed against the darkened subcomponent while others of the plurality of subcomponents are left in their source format. The at least one darkened subcomponent, selected ones of the subcomponents, and the subcomponents that are in their source format are composited into a composite view; and displayed.

22 Claims, 8 Drawing Sheets

(56) References Cited

U.S. PATENT DOCUMENTS

| | | | | |
|---|---|---|---|---|
| 2008/0238837 | A1* | 10/2008 | Yamaguchi | 345/77 |
| 2010/0091029 | A1* | 4/2010 | Han et al. | 345/589 |
| 2010/0149197 | A1* | 6/2010 | Plut | G06F 1/3218 345/522 |
| 2010/0174930 | A1* | 7/2010 | Kim et al. | 713/320 |
| 2011/0069089 | A1* | 3/2011 | Kopf et al. | 345/690 |
| 2012/0127198 | A1* | 5/2012 | Gundavarapu | 345/629 |

OTHER PUBLICATIONS

"D.C.T.W.Y.C.D.T.—Don't Code Today What You Can't Debug Tomorrow", Blog post found at http://ariya.blogspot.com/2010/10/color-inversion-for-web-pages.html downloaded Oct. 8, 2010, Oct. 6, 2010, p. 7, Published in: US.

Ranganathan, P., et al., "Energy-Aware User Interfaces and Energy-Adaptive Displays", Computer—Mar. 2006 Whitepaper downloaded Nov. 25, 2009, Mar. 2006, pp. 31-38, Publisher: IEEE Comp. Soc'y, Published in: US.

* cited by examiner

METHOD AND APPARATUS FOR CONTENT-BASED REDUCTION OF DISPLAY POWER

FIELD OF THE INVENTION

The present invention relates to content display devices. In particular, but not by way of limitation, the present invention relates to apparatus and methods for managing power on content display devices.

BACKGROUND OF THE INVENTION

Content display devices such as smartphones, netbooks, gaming devices, PDAs, desktop computers, televisions, and laptop computers are now ubiquitous. A common and ongoing issue with these types of devices is power management. More specifically, these types of devices continue to deliver more advanced processing resources and communication systems that demand more and more power. And in addition, users have become accustomed to using content display devices more often, and grown accustomed to using them more often in connection with web browsing activity.

Display power on a computing device typically represents a significant portion of the overall power dissipation. In connection with traditional displays (e.g., TFT and CSTN displays), attempts have been made (especially in the context of mobile computing devices) to increase the perceived contrast while reducing power that is consumed by the backlight. For example, many techniques have been developed to provide adaptive backlight control that basically reduces the intensity of the backlights without severely impacting the visual quality of the image being displayed.

Display technology, however, is quickly transitioning to light-weight, better-performing, and more energy efficient organic light emitting diode (OLED) displays, which do not use power-intensive backlighting. Nonetheless, OLED displays continue to be a substantial portion of the power that is utilized in a content display device. But existing power management techniques (e.g., backlight management techniques) are not applicable to OLED-type devices, and as a consequence, different techniques are necessary to reduce the power demands of OLED-type displays.

SUMMARY OF THE INVENTION

Illustrative embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

In accordance with several embodiments, the invention may be characterized as a method for displaying content that includes darkening a subcomponent with the larger color surface of received content to generate at least one darkened background, and adjusting a contrast of selected subcomponents of the content to enable the selected subcomponents to be viewed against the darkened background while other subcomponents are left in their source format. The darkened background, the selected subcomponents, and the subcomponents that are in their source format are composited into a composite view and then displayed.

Another embodiment of the invention may be characterized as a method for displaying content that includes determining an entire pixel area of a composite view of content, determining a pixel area of nonadjustable subcomponents to obtain a nonadjustable pixel area, and subtracting the nonadjustable pixel area from the entire pixel area to obtain an adjustable pixel area. In addition, an anticipated power load of the adjustable pixel area is determined, and a selected color surface of the content is darkened in response to the anticipated power load exceeding a threshold. In addition, a contrast of selected ones of the subcomponents is adjusted so the subcomponents may be viewed against the darkened color surface. For instance, in a simplified example, black text on a white background may become white text on a black background.

Yet another embodiment of the invention may be characterized as a method for displaying content that includes accessing a color table to retrieve permissible background and foreground color-combination data, darkening a selected color surface, and adjusting the contrast of selected ones of the subcomponents in accord with the permissible background and foreground color-combination data. The selected color-combinations may be dependent on the ambient lighting conditions. For example, in bright sunlight, more intensity and contrast are needed than a typical indoor environment with artificial lighting.

Yet another embodiment of the invention may be characterized as a content display device that includes a rendering component disposed to receive and render web page content that includes a plurality of subcomponents. The device also includes a selective object adjustment component that darkens at least one subcomponent with a larger color surface to generate at least one darkened background and adjust, relative to the at least one background, a contrast of selected ones of the subcomponents so as to enable the selected ones of the subcomponents to be viewed against the darkened subcomponent while leaving others of the plurality of subcomponents in their source format. A composition component composites the darkened subcomponent, the selected ones of the subcomponents, and the subcomponents that are in their source format into a composite view, and the composite view is presented on a display.

Another embodiment of the invention may be characterized as a non-transitory, tangible computer readable storage medium that is encoded with processor readable instructions to perform a method for displaying content. The method includes receiving content that includes a plurality of subcomponents including a subcomponent with a relatively large color surface, and darkening the subcomponent with the relatively large color surface so as to generate at least one darkened background. In addition, a contrast of selected ones of the subcomponents is adjusted so as to enable the selected ones of the subcomponents to be viewed against the darkened subcomponent, and others of the plurality of subcomponents are left in their source format. The darkened subcomponent, the selected ones of the subcomponents, and the subcomponents that are in their source format are composited into a composite view and displayed.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawings where like or similar elements are designated with identical reference numerals throughout the several views and wherein:

DETAILED DESCRIPTION

Figure 1:
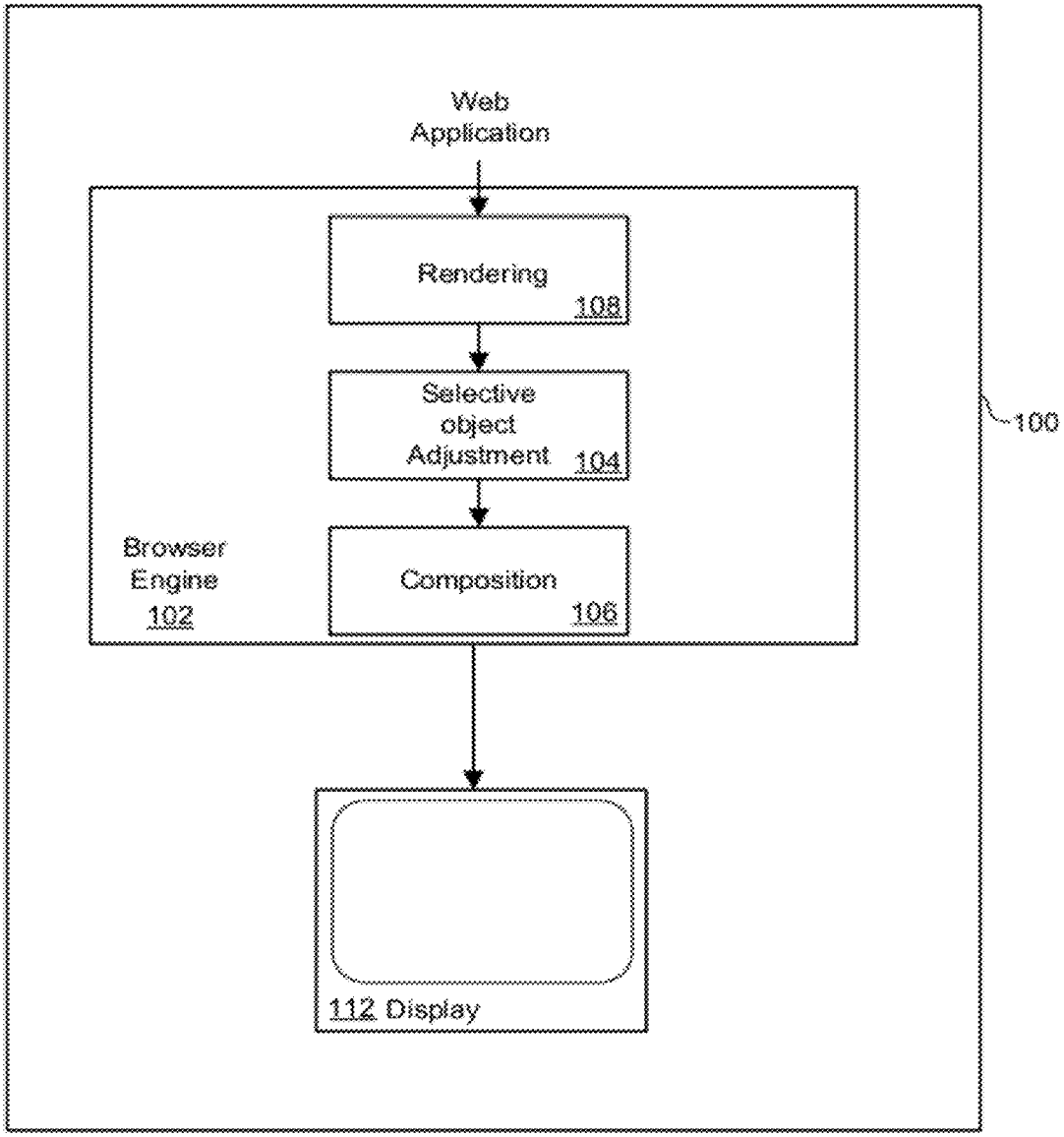
FIG. 1 is a block diagram depicting an exemplary embodiment of a content display device.

Referring first to FIG. 1, it is a block diagram depicting an embodiment of an exemplary content display device 100. As shown, the content display device 100 includes a browser engine 102 that is disposed and configured to receive web data from a web application and selectively adjust subcomponents (also referred to herein as objects) of the web data so as to render the web data on a display 112 in a format that is less power intensive than rendering the web data in its source format (e.g., the format the web data is in when received by the content display device 100). As discussed further herein, the browser engine 102 may be realized by modifying an existing browser engine (e.g., a modified Webkit engine) so as to include a selective object adjustment component 104. As shown, the selective object adjustment component 104 is coupled to both a composition component 106 and a rendering component 108, and the browser engine 102 is coupled to the display 112.

The depiction of these components is logical and is not intended to be an actual hardware diagram. For example, the division of the browser engine 102 into three components is for exemplary purposes only, and as discussed further herein, each component may be further separated into constituent components, but it should also be recognized that the components may be integrated to such an extent that each component may not be separately recognizable in actual implementation. Moreover, the components may be realized by hardware, software, firmware, or a combination thereof.

The display 112 in this embodiment generally presents dynamic content to a user of the content display device 100 and draws power as a function of the displayed content. For example, the display 112 generally draws less power the darker the content that is being displayed. In other words, the display 112 generally draws more power as the display of content becomes lighter and draws less power as the content that is displayed becomes darker. It should be recognized, however, that the energy savings that is associated with the darkness of the display 112 is not due to backlighting. More specifically, the energy savings associated with darkening the content is derived from the operating characteristics of the individual light emitting components (e.g., organic light emitting diodes) and is not based upon reducing the luminous flux or radiant flux of a backlight.

In several embodiments, the display is realized by organic light-emitting diode (OLED) type technology, but it is contemplated that the selective object adjustment techniques described herein may be utilized in connection with other yet-to-be developed displays that have power load profiles that are similar to OLED displays (e.g., displays without backlights that have power profiles that vary as a function of the content displayed). Moreover, it is contemplated that other adjustments (e.g., to threshold levels discussed further herein) may be made in connection with the methodologies disclosed herein to accommodate variations among displays (e.g., variations in terms of the load characteristics that different types of displays have relative to the colors displayed).

The rendering component 108 generally functions to receive web page content from a web application and transform the received objects into a raster. For example, the rendering component 108 transforms bitmap graphics, vector graphics and text that make up a web page into a raster that can be displayed on screen. A typical web page may have more than 150 objects to render, which may include one or more backgrounds, scripting-language objects (e.g., JavaScript), HTML objects, CSS objects, JPEGs, PNGs, and video objects.

Figure 7:
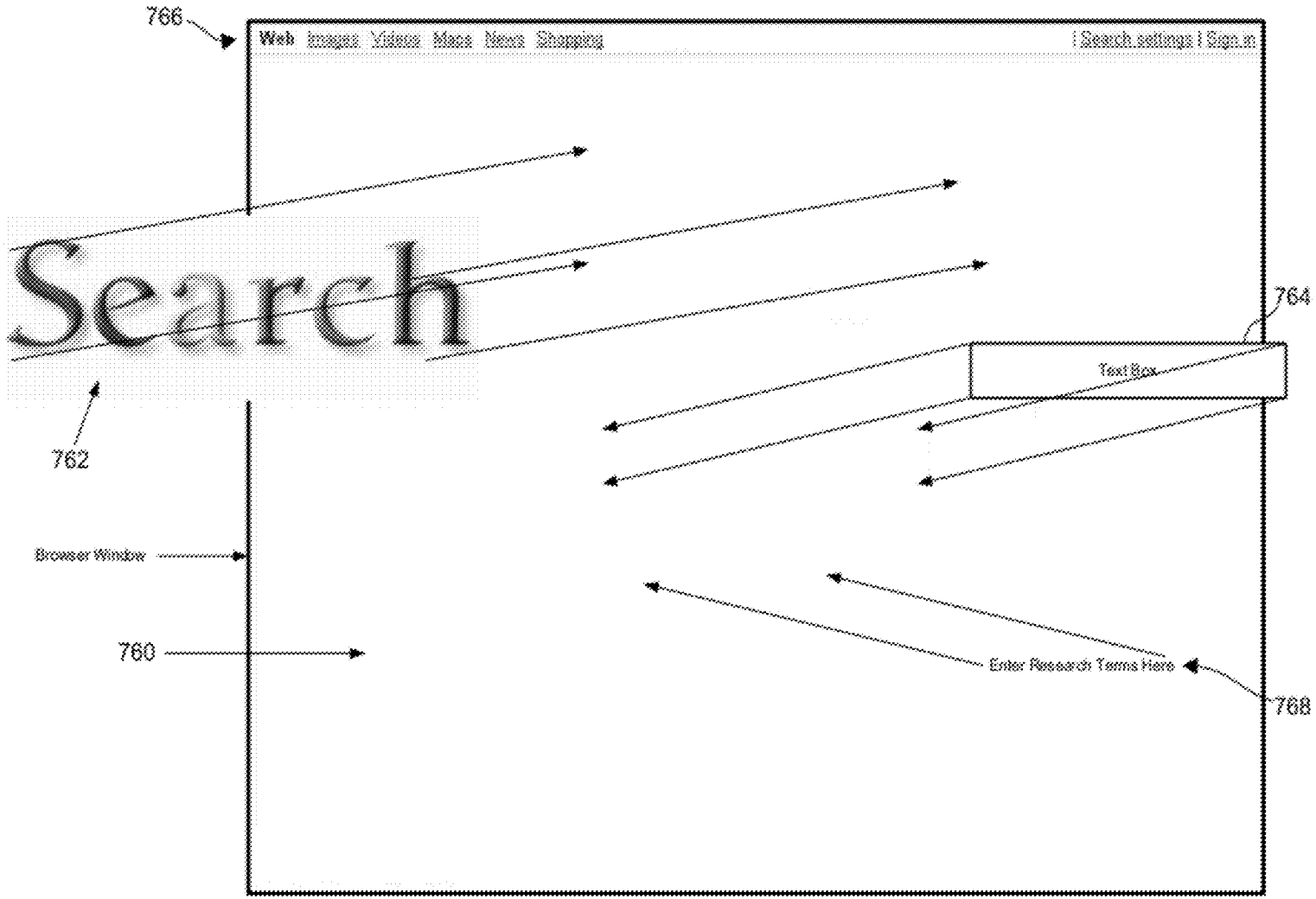
FIG. 7 depicts exemplary constituent subcomponents of a web page.
Figure 8:
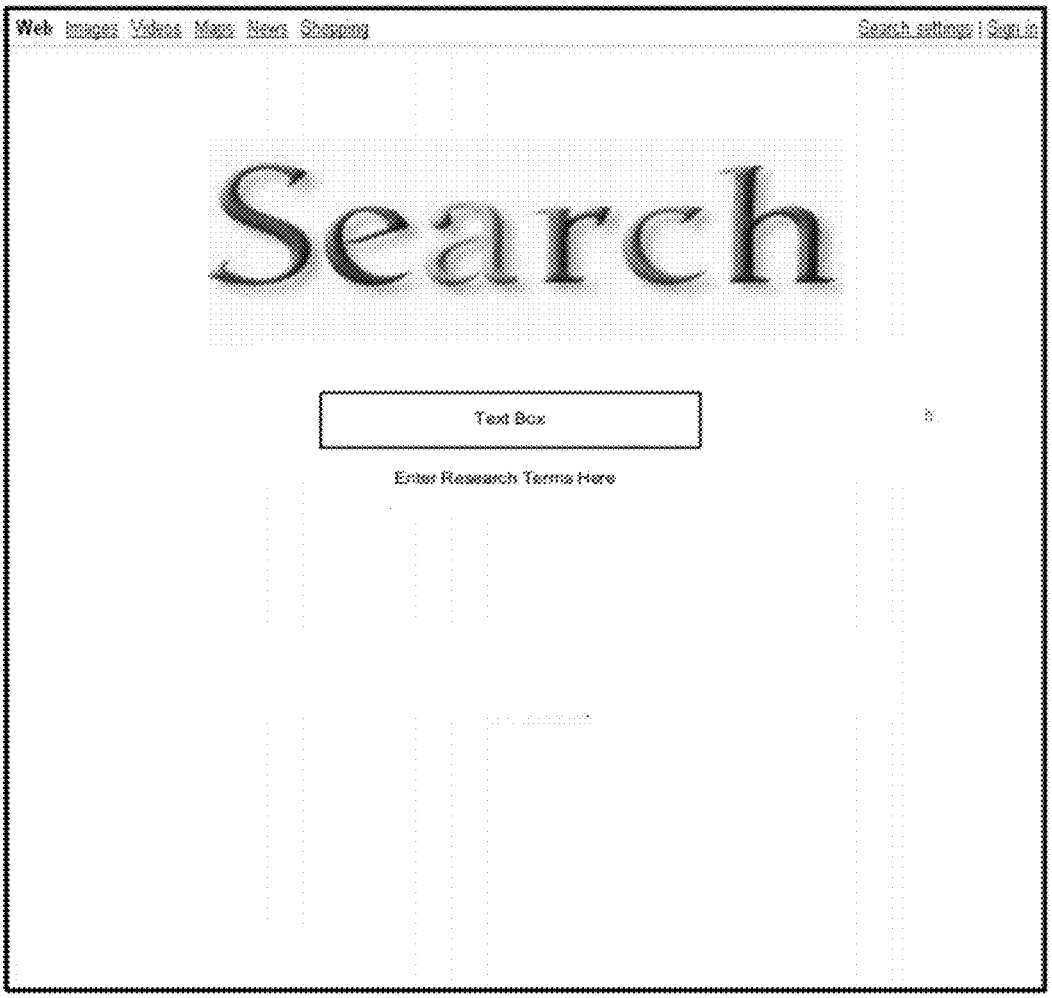
FIG. 8 depicts the constituent subcomponents of FIG. 7 in a composite, web view form.

Referring briefly to FIG. 7 for example, shown is a depiction of exemplary subcomponents of a web page. As shown, the subcomponents include a background 760, an image 762, a text box 764, HTML text 766, and text 768. As depicted in FIG. 7, the objects are separate elements that may be layered and combined, and in a typical browser engine, the composition component 106 receives the rasterized objects from the rendering component 108 (i.e., subcomponents that have not been contrast-adjusted) and composites the objects in their source format, to render a composite, web view of the page as depicted in FIG. 8.

In this embodiment, however, the selective object adjustment component 104 darkens one or more subcomponents (e.g., background objects) so that when the web page is displayed (after compositing), the display consumes less power. For example, most often (but not always) web pages (like the web page depicted in FIG. 8) are designed with backgrounds that are white or relatively light, and in many instances these backgrounds may be inverted (e.g., from white to black) or substantially darkened (e.g., from a lighter shade to a darker shade). And at the same time, the selective object adjustment component 104 adjusts foreground objects (e.g., by inverting the objects or lightening the objects) that are positioned on top of the background(s) so that the objects have an acceptable contrast relative to the inverted or darkened background(s). A simple example is one of an e-book reader, whereby a typical e-book has black text on a white background. A more power efficient solution for OLEDs would be white text on a dark background since that will result in more dark pixels, and hence, lower overall power.

But many foreground objects should not undergo an adjustment because the user's experience would be significantly diminished. For example, inverting or substantially lightening images (e.g., photographs), text boxes, and videos may be especially unappealing to a user. As a consequence, the selective object adjustment component 104 adjusts selected ones of the subcomponents received from the rendering 108 component.

In some embodiments, an assumption is made that a background (e.g., background 760) will generally be lighter than a mid-level gray and objects are adjusted (e.g., inverted) or not based upon object type in advance of any compositing. For example, in some implementations bitmap objects including images (e.g., JPEG, PNG, GIF, TIFF), plug-in-dependent objects (e.g., Flash) and video are not inverted.

And in some variations of these embodiments, an anticipated power load of a web page in its source format is calculated and compared against a threshold level before any adjustments are made to objects. For example, if a web page (in its source format) does not exceed a certain power threshold, it may be assumed that any potential reduction in power that may be attained by darkening a background (and adjusting the contrast of other objects) is not significant enough to warrant the potential unaesthetic effects. By way of further example, if a background is already darker than a mid-level gray, the power load of the displayed webpage may already be near an optimal level—especially when considering desired appearance/aesthetic attributes).

To determine the anticipated power draw of a particular web page in its source format, calibration data (based upon prior power measurements of the display 112 taken in connection with potential color and shade combinations) may be utilized. It is anticipated that the power load profiles of displays are likely to vary from display manufacturer to display manufacturer and from model to model and perhaps even from manufacturing lot to lot; furthermore, the power load profile may not be linear; thus display-specific calibration data may provide a more accurate basis for assessing whether to darken background(s) and lighten foreground objects. Although many examples are provided herein in which a background subcomponent is darkened, in general, a subcomponent with a relatively large color surface (e.g., the largest color surface) may be darkened while other ones of the subcomponents are not darkened. A color surface in this context refers to a subcomponent (e.g., an object) which is visible (not obscured by other objects) and spans a large number of pixels once rendered and composited.

In some variations, to arrive at a more accurate assessment of whether it makes sense to darken the background(s) and adjust foreground objects, the total pixel area of those objects that are nonadjustable (e.g., images and video) is subtracted from the total web page pixel area to arrive at a total adjustable area, and an assessment of only the content in the adjustable area is considered to determine whether darkening the background and adjusting (e.g., lightening) foreground objects in the adjustable area is warranted.

In yet other embodiments, a color table is utilized to arrive at visually acceptable (e.g., subjectively acceptable) combinations of background and foreground object color combinations. In some modes of operation for example, the color table may be accessed to determine whether one or more of the background and foreground object colors may be utilized together to provide an overall darker screen with aesthetically acceptable appearance, given the current ambient lighting conditions.

In some variations, a color table is accessed during composition and after a determination is made to darken background(s) and lighten foreground objects to arrive at an acceptable combination of contrast and/or color combinations. And in yet other variations, the color tables may be utilized in connection with the initial assessment whether or not to adjust the background and foreground objects at all. For example, the potential color combinations that may be utilized may affect the threshold that is utilized in connection with the power profile of the display. More specifically, the color tables may define what adjustments may be made to the objects and; thus may affect whether any power savings may be obtained in view of the color-table constraints. Note that this composition mode can be utilized either when inverting or darkening. In the case of the e-book example, inverting will convert white background to black and black text to white, and this generally produces the largest power savings. However, it also produces the most extreme visual difference from the source, but the visual quality can be enforced by careful consideration of the color tables so the best color font is put on a background with a particular shade of gray, for example. A more subtle approach is simply to slightly darken the light background, for example, from bright white to a pearl white. This doesn't produce the optimum power savings, but it does maintain roughly the same visual experience and still provides some power savings.

It is also contemplated that OEMs, carriers, and device (e.g., smartphone, netbook, laptop, etc) manufacturers may dictate the potential color combinations that may be utilized, and a color table enables the permissible color-combinations to be varied based upon subjective assessments and based upon physical capabilities of particular displays. An example might be in an area where fonts are complex, such as Hindi, Konji or Arabic fonts, the users tend to like a sharper contrast in order to make out the characters more clearly without having to zoom in too much. Additionally, viewing in bright sunlight requires more contrast and intensity than in darker environments, so input from an ambient light sensor is important to adjust the visual quality to the user's environment.

Moreover, all of the previously discussed embodiments may also incorporate a user input that enables a user to configure the selective adjustment of background(s) and foreground objects to their preferences. For example, a user may set the selective object adjustment component 104 to adjust only particular types of subcomponents (e.g., the user may desire that only text objects be adjusted), or the user may set the selective object adjustment component 104 so that, when the availability of power on the mobile computing device falls below a threshold, either default objects are adjusted or user-selected objects are adjusted. Moreover, the user may also select a darkness level that a background defaults to.

Figure 2:
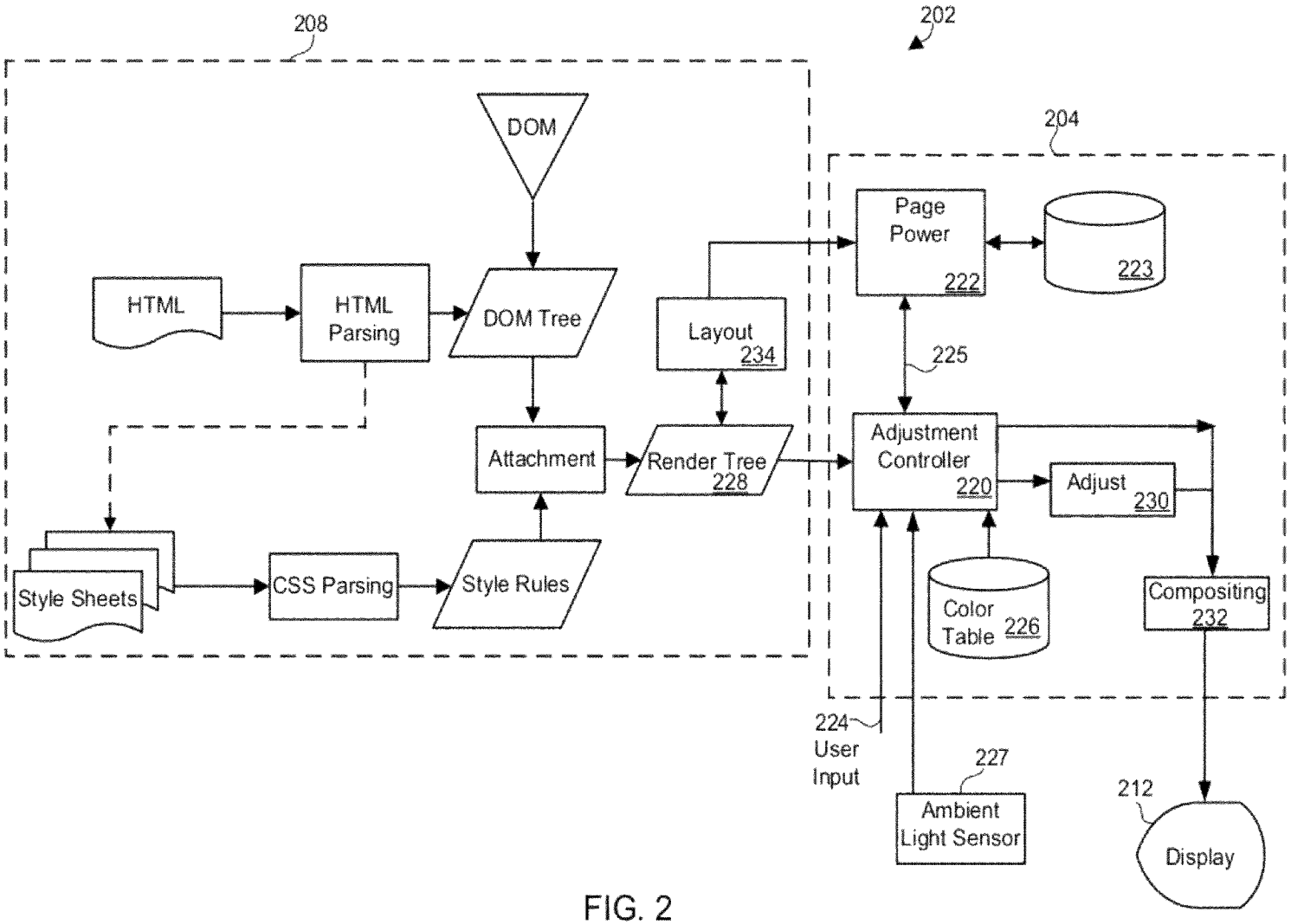
FIG. 2 is a block diagram depicting an exemplary embodiment of an inventive browser engine.

Referring next to FIG. 2, it is a block diagram depicting an exemplary embodiment of a browser engine 202 that may be used to implement the browser engine 102 depicted in FIG. 1. As shown, the browser engine 202 in this embodiment includes a rendering component 208 from a Webkit engine, but this is certainly not required, and other rendering components may be utilized. The functions of each component of the exemplary rendering component 208 are well known, and as a consequence, the details of the function and interoperation of each component is not included herein. But in general, the rendering component 208 receives web page components and renders the subcomponents in pixel form.

As shown, a selective adjustment component 204 in this embodiment is coupled between a display 212 and the rendering component 208, and the selective adjustment component 204 includes an adjustment controller 220 that receives inputs from a page power component 222, a user input 224 and a color table 226, and an ambient light sensor 227. In addition, the adjustment controller 220 receives objects from a render tree 228 and directs whether the objects are adjusted by an adjustment block 230 or passed through to a compositing component 232.

Again, the depicted arrangement of components in FIG. 2 is exemplary only, and one of ordinary skill in the art, in light of this disclosure, will appreciate that different web browser configurations may be utilized without departing from the scope of the present invention.

In general, the adjustment controller 220 controls the adjustment of web page objects based upon inputs from the page power component 222, user input 224, and the color tables 226. Although some embodiments (e.g., some of the embodiments discussed with reference to FIG. 1) operate to selectively lighten objects (while darkening the backgrounds) solely on the basis of the object type, in the embodiment depicted in FIG. 2, the page power component 222 and color table 226 enable more efficient and aesthetically appealing results.

With respect to the page power component 222, it is generally configured to calculate, based upon the content of each pixel, an anticipated power load of a particular web page if the web page were to be displayed in its source format. Because the power characteristics of the display 212 may vary based upon the manufacturer, resolution, and other factors, the page power component 222 may be calibrated for each platform. For example, calibration data 223 may be gathered in advance of use to determine the power characteristics of the display 212 as a function of the potential color and shade combinations.

Although not required, the page power component 222 in this embodiment is disposed to communicate with a layout portion 234 so that the page power component 222 may calculate the anticipated power of only the area of a web page that is amenable to adjustment. For example, the page power component 222 may subtract the total pixel area of those objects that are nonadjustable from the total web page pixel area to arrive at a total adjustable area, and only the content in the adjustable area is utilized to calculate the anticipated page power. As discussed further herein, the anticipated page power enables a determination to be made as to whether the potential exists to obtain power savings by darkening a background and lightening objects in the foreground of the adjustable area. As a consequence, the adjustment controller 220 may compare the output of the page power component 222 to a threshold to determine whether it makes sense to make any adjustments at all to the adjustable objects.

Although many variations of the page power component 222 provide an indication of an anticipated power load of a given web page, the output 225 of the page power component 222 may vary. For example, the output 225 may be in terms of power (e.g., Watts), Amps, page intensity, or page brightness, but generally these terms are indicative of power, and for simplicity, the output 225 of the page power component 222 is generally discussed herein in terms of power.

When adjustments are made to selected objects, the color table 226 enables the adjustment controller 220 to direct particular adjustments to be made to background objects(s) and foreground objects based upon permissible color-combination data in the color table 226. Although other viable embodiments simply invert one or more backgrounds and invert one or more foreground objects, in the embodiment depicted in FIG. 2 (and other embodiments utilizing the color table 226), the color table 226 may provide data that identifies a particular color, shade, and/or color intensity that may be utilized for foreground objects in combination with a particular darkened background (e.g., to provide an aesthetically pleasing contrast).

Figure 3:
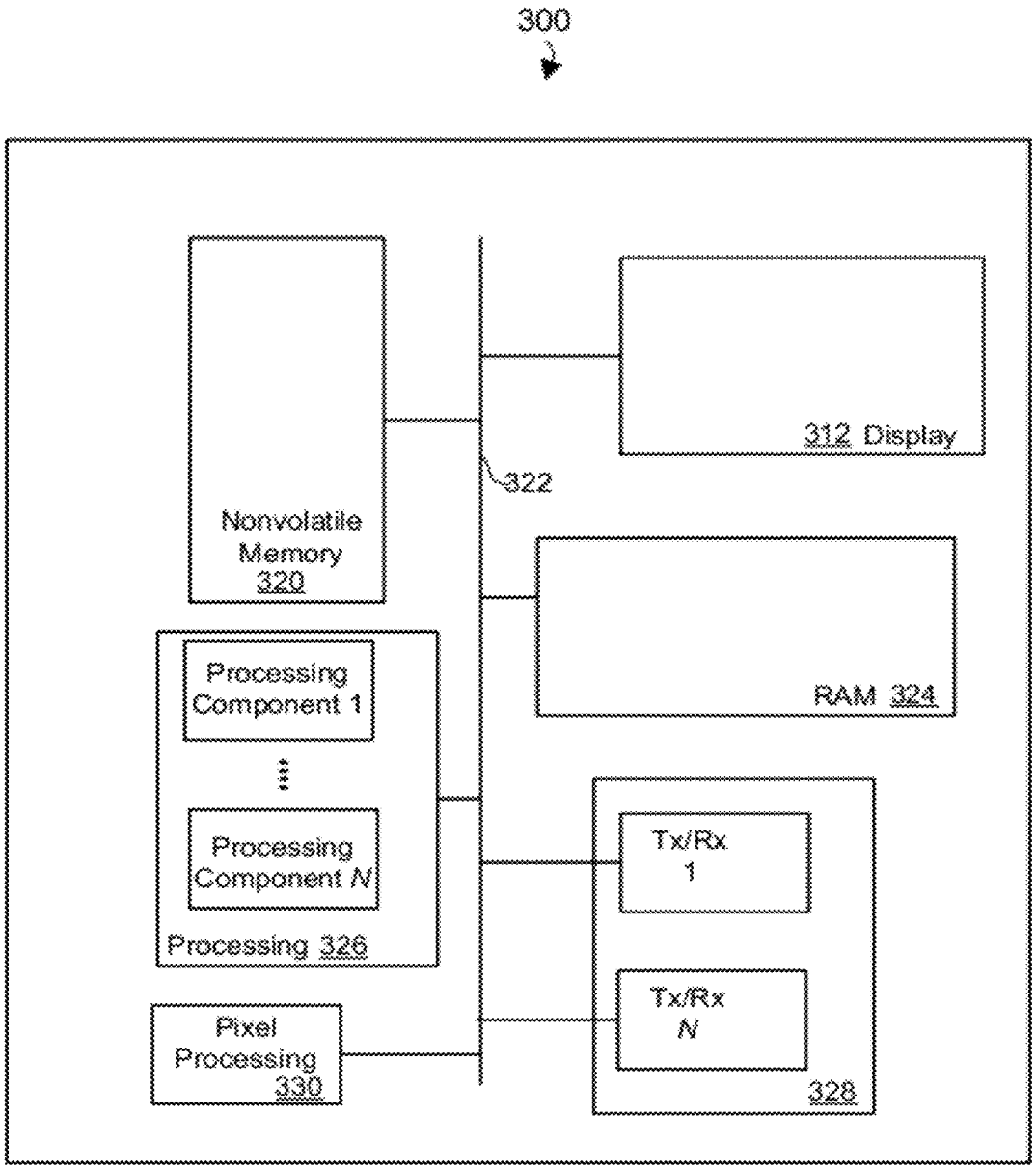
FIG. 3 is a block diagram depicting physical components that may be used to realize the functional components depicted in FIGS. 1 and 2.

Referring next to FIG. 3, shown is a block diagram depicting physical components of an exemplary content display device 300 that may be utilized to realize the content display device 100 described with reference to FIG. 1 and the browser engine 202 depicted in FIG. 2. As shown, the content display device 300 in this embodiment includes a display portion 312, and nonvolatile memory 320 that are coupled to a bus 322 that is also coupled to random access memory ("RAM") 324, a processing portion (which includes N processing components) 326, a transceiver component 328 that includes N transceivers, and a pixel processing component 330. Although the components depicted in FIG. 3 represent physical components, FIG. 3 is not intended to be a hardware diagram; thus many of the components depicted in FIG. 3 may be realized by common constructs or distributed among additional physical components. Moreover, it is certainly contemplated that other existing and yet-to-be developed physical components and architectures may be utilized to implement the functional components described with reference to FIG. 3.

This display portion 312 generally operates to provide a presentation of content to a user, and in several implementations, the display is realized by an OLED display. But it is contemplated that the methodologies and constructs disclosed herein may be used in connection with other types of displays that include discrete pixel-sized light emitting components that draw power as a function of the content that is displayed.

In general, the nonvolatile memory 320 functions to store (e.g., persistently store) data and executable code including code that is associated with the functional components depicted in FIGS. 1 and 2. In some embodiments for example, the nonvolatile memory 320 includes bootloader code, modem software, operating system code, file system code, and code to facilitate the implementation of one or more portions of the selective object adjustment components 104, 204 discussed in connection with FIGS. 1 and 2 as well as the other web browser components.

In many implementations, the nonvolatile memory 320 is realized by flash memory (e.g., NAND or ONENAND™ memory), but it is certainly contemplated that other memory types may be utilized as well. Although it may be possible to execute the code from the nonvolatile memory 320, the executable code in the nonvolatile memory 320 is typically loaded into RAM 324 and executed by one or more of the N processing components in the processing portion 326.

The N processing components in connection with RAM 324 generally operate to execute the instructions stored in nonvolatile memory 320 to effectuate the functional components depicted in FIGS. 1 and 2. As one of ordinarily skill in the art will appreciate, the processing portion 326 may include a video processor, modem processor, DSP, graphics processing unit (GPU), and other processing components. The pixel processing component 330 depicted in FIG. 3 may be utilized on connection with the processing portion 326 to manage the additional processing that is associated with the functions carried out by the selective object adjustment component 104, 204. The pixel processing component 330 may be realized by a CPU, GPU, or display processor (e.g., mobile display processor).

The depicted transceiver component 328 includes N transceiver chains, which may be used for communicating with external devices via wireless networks. Each of the N transceiver chains may represent a transceiver associated with a particular communication scheme.

Figure 4:
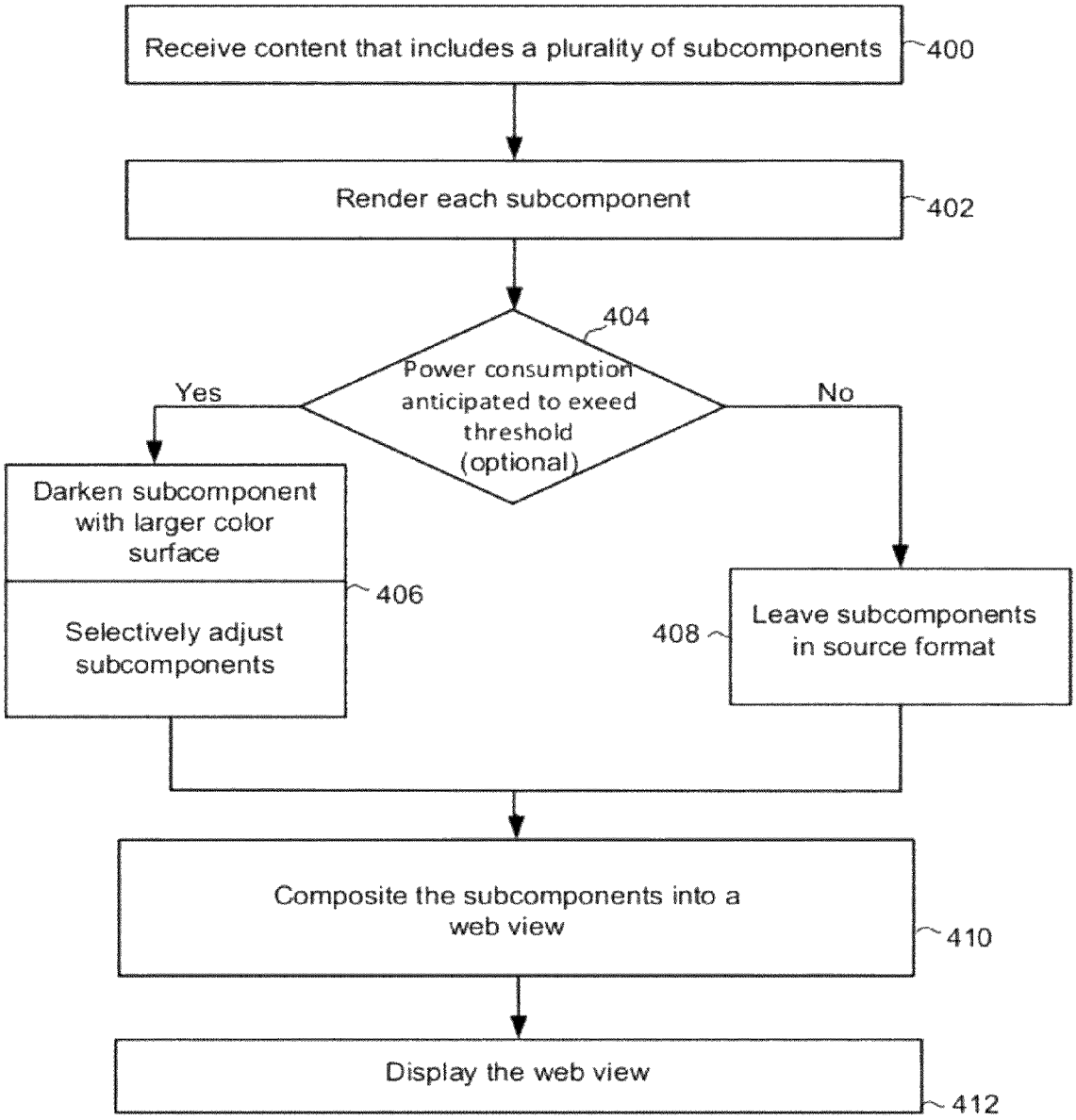
FIG. 4 is a flowchart that depicts a method that may be carried out in connection with the embodiments described with reference to FIGS. 1-3.

Referring next to FIG. 4, it is a flowchart depicting steps that may be traversed in connection with the embodiments described with reference to FIGS. 1-3. As shown, initially content is received (e.g., from a web application) that includes a plurality of subcomponents (e.g., background objects and foreground objects)(Block 400), and each of the subcomponents are rendered (e.g., by rendering components 108, 208) (Block 402).

As shown in FIG. 4, an assessment is optionally made as to whether an anticipated power consumption of a web page in its source format will exceed a threshold (Block 404). Although not required, assessing whether the anticipated power of a web page exceeds a threshold helps to prevent making adjustments that may actually increase power consumption. As another example, if the source format of the web page already includes a relative dark background, making additional adjustments may not achieve any power savings and/or may adversely affect the aesthetic content of the web page.

As shown, if the anticipated consumption does not exceed a threshold, the subcomponents of the web page are left in the source format (Block 408), composited into a web view (Block 410), and the web view is displayed (Block 412). But if the anticipated power consumption exceeds a threshold (Block 404), a subcomponent with a larger color surface than other ones of the subcomponents (e.g., the background or potentially backgrounds) are darkened and other subcomponents are selectively adjusted (e.g., so as to improve the relative contrast between the darkened subcomponent and the other subcomponents)(Block 406), and then the subcomponents are composited into a web view (Block 410), and the web view is displayed (Block 412).

Figure 5:
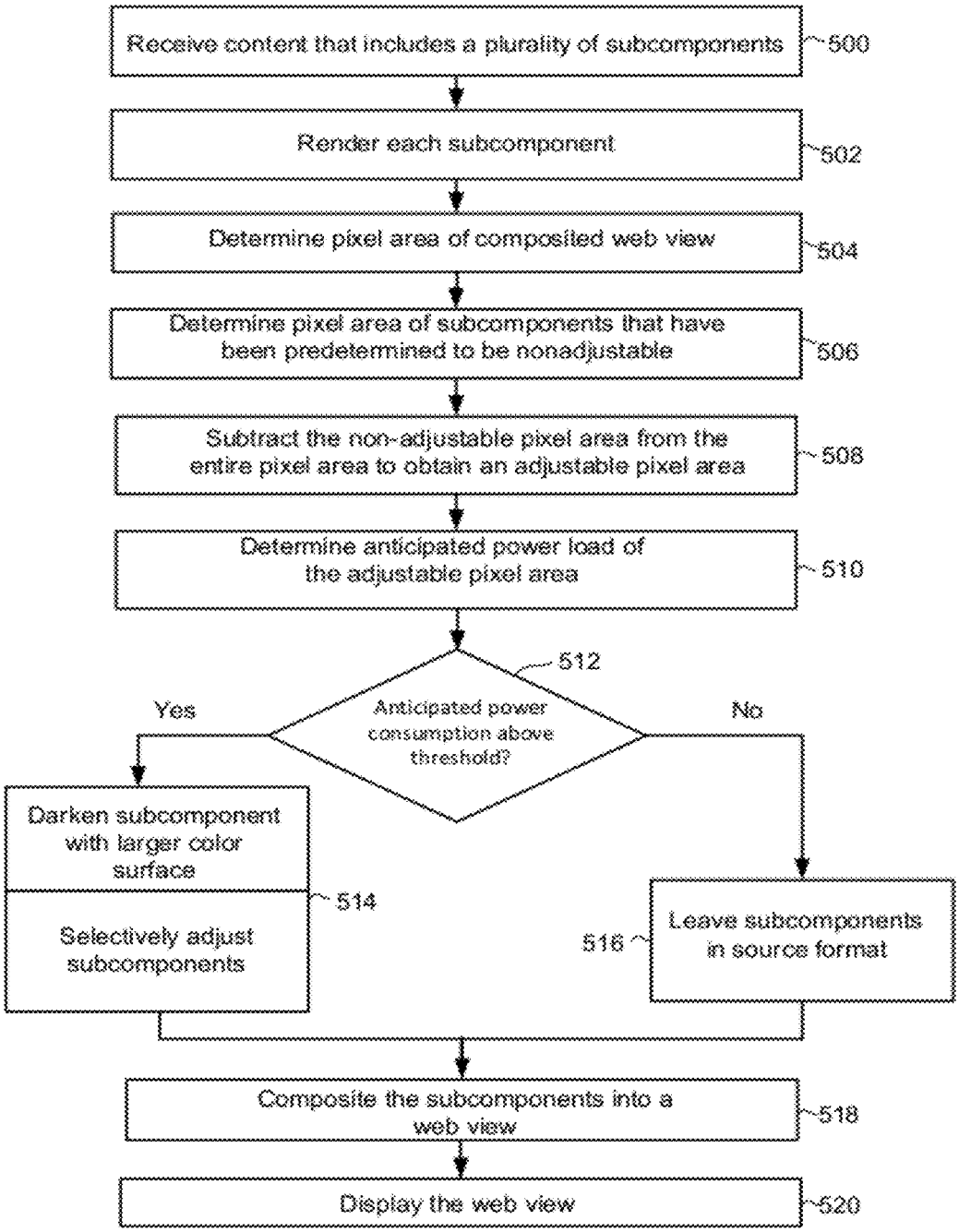
FIG. 5 is a flowchart that depicts another method that may be carried out in connection with the embodiments described with reference to FIGS. 1-3.

Referring next to FIG. 5, shown is a flowchart depicting another method that may be carried out in connection with the embodiments described with reference to FIGS. 1-3. In this method, as in the method described with reference to FIG. 4, content that includes a plurality of subcomponents is received (Block 500) and each of the subcomponents is rendered (Block 502). But in the method depicted in FIG. 5, a pixel area of a web view of the page is determined (Block 504), and in addition, a pixel area of subcomponents that have been predetermined to be nonadjustable is also determined (Block 506). Then the nonadjustable pixel area is subtracted from the entire pixel area of the web view to obtain an adjustable pixel area (Block 508), and the anticipated power load of the adjustable pixel area is determined. (Block 510).

As shown in FIG. 5, if the anticipated power load of the adjustable pixel area does not exceed a threshold (Block 512), the subcomponents of the web page are left in the source format (Block 516), composited into a web view (Block 518), and the web view is displayed (Block 520). But if the anticipated power consumption of the adjustable pixel area exceeds the threshold, a subcomponent with a larger color surface than other subcomponents (e.g., background or potentially backgrounds) is darkened and other subcomponents are selectively adjusted (Block 514), and then the subcomponents are composited into a web view (Block 518), and the web view is displayed (Block 520).

Figure 6:
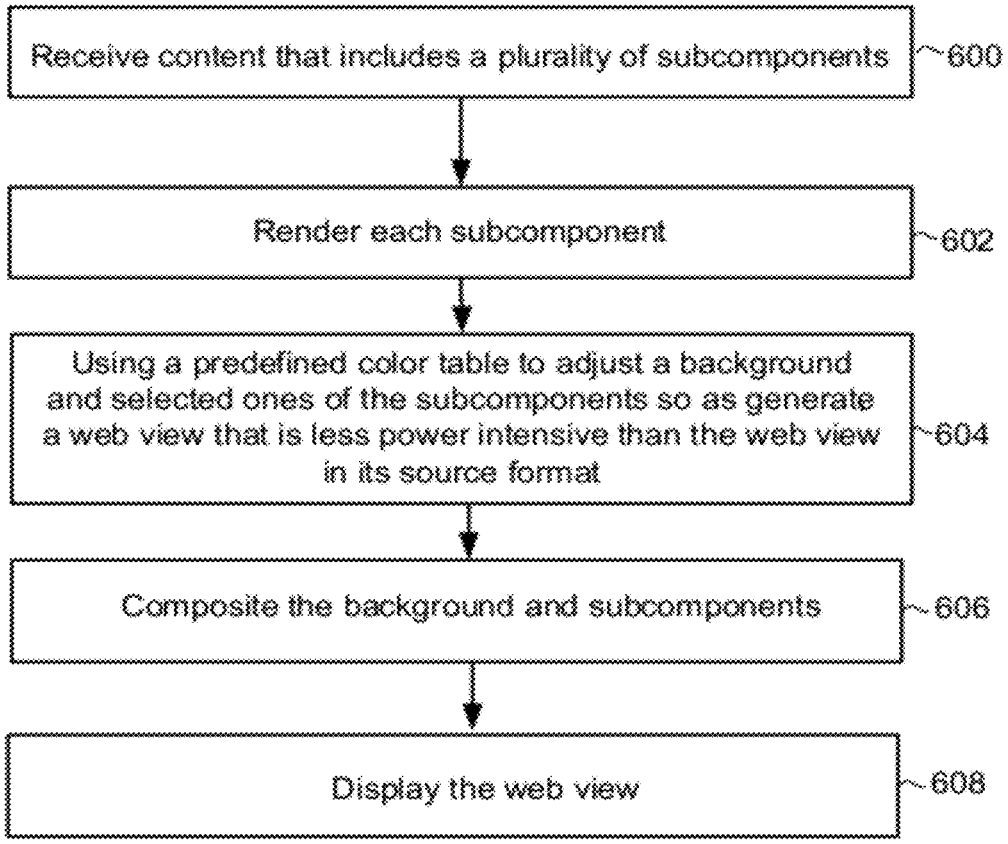
FIG. 6 is a flowchart that depicts yet another method that may be carried out in connection with the embodiments described with reference to FIGS. 1-3.

Referring next to FIG. 6, shown is a flowchart depicting yet another method that may be carried out in connection with the embodiment described with reference to FIGS. 1-3. As shown, just as in the methods described with reference to FIGS. 4 and 5, content that includes a plurality of subcomponents is received (Block 600) and each of the subcomponents is rendered (Block 602). But in this method, a predefined color table (e.g., color table 226) is utilized (e.g., during compositing) to adjust a background and selected ones of the subcomponents so as to generate a web view that is less power intensive than the web view in its source format (Block 604). As discussed, in the context of OLED displays, the darker the colors that are displayed (e.g., the less intense or the more shading the colors have), the less power that is consumed. As a consequence, in many implementations, the background and selected objects are adjusted so that overall, on average, the displayed web view is darker than the web view would be if the objects were rendered in their source format. Moreover, the color table enables color combinations to be selected and controlled in advance of compositing so that aesthetic aspects of the presentation of content may be controlled during compositing. As shown in FIG. 6, the background (e.g., in its adjusted form) and other subcomponents are then composited (Block 606) and the web view is displayed (Block 608).

In conclusion, embodiments of the present invention reduce power consumption on a content display device by selectively adjusting subcomponents of the content. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A method for displaying content, the method comprising:

receiving content that includes a plurality of subcomponents, the plurality of subcomponents including a subcomponent with a larger color surface than other ones of the plurality of subcomponents;

rendering each of the plurality of subcomponents;

darkening the subcomponent with the larger color surface so as to generate a darkened subcomponent;

adjusting a contrast, relative to the darkened subcomponent, of selected ones of the plurality of subcomponents so as to enable the selected ones of the plurality of subcomponents to be viewed against the darkened subcomponent;

leaving others of the plurality of subcomponents in their source format;

compositing the darkened subcomponent, the selected ones of the plurality of subcomponents, and the others of the plurality of subcomponents that are in their source format into a composite view;

determining an entire number of pixels of the composite view;

determining a number of pixels of nonadjustable subcomponents so as to obtain a nonadjustable number of pixels;

subtracting the nonadjustable number of pixels from the entire number of pixels to obtain a ratio reflecting an adjustable number of pixels; and determining an anticipated power load of the adjustable number of pixels, wherein the anticipated power load of the adjustable number of pixels is a power load of the adjustable number of pixels if the adjustable number of pixels were displayed with adjustable subcomponents in their source format;

wherein the darkening the subcomponent with the larger color surface and the adjusting the contrast of the selected ones of the plurality of subcomponents is responsive to the anticipated power load of the adjustable number of pixels exceeding a threshold; and displaying the composite view.

2. The method of claim 1, wherein darkening the subcomponent with the larger color surface includes inverting the subcomponent with the larger color surface so as to generate the darkened subcomponent, and wherein adjusting a contrast of selected ones of the plurality of subcomponents includes inverting the selected ones of the plurality of subcomponents.

3. The method of claim 1, wherein darkening includes making an adjustment selected from the group consisting of reducing an intensity, selecting a darker color value, and reducing a saturation.

4. The method of claim 1, wherein the nonadjustable subcomponents are predetermined to be nonadjustable based upon a type of each of the subcomponents.

5. The method of claim 4, wherein the types of subcomponents that are predetermined to be nonadjustable are selected from the group consisting of images, videos, and canvas objects.

6. The method of claim 5, wherein the nonadjustable subcomponents are slightly adjusted by reducing an intensity or reducing saturation.

7. The method of claim 1, including:

accessing a color table to retrieve permissible color-combination data;

wherein darkening the subcomponent with the larger color surface and adjusting the contrast of selected ones of the plurality of subcomponents includes darkening the subcomponent with the larger color surface and adjusting the contrast of selected ones of the plurality of subcomponents in accord with the permissible color-combination data.

8. A content display device including:

a rendering component disposed to receive and render web page content that includes a plurality of subcomponents, the plurality of subcomponents including at least one background;

a selective object adjustment component that darkens a subcomponent with a larger color surface than other ones of the plurality of subcomponents so as to generate at least one darkened subcomponent and adjust, relative to the darkened subcomponent, a contrast of selected ones of the plurality of subcomponents so as to enable the selected ones of the plurality of subcomponents to be viewed against the darkened subcomponent while leaving others of the plurality of subcomponents in their source format;

a composition component that composites the darkened subcomponent, the selected ones of the plurality of subcomponents, and the others of the plurality of subcomponents that are in their source format into composite view;

a page power component configured to provide an indication of an anticipated power load of an adjustable number of pixels of the composite view if the adjustable number of pixels were displayed in their source format, wherein the selective object adjustment component darkens the subcomponent with the larger color surface and adjusts the adjustable number of pixels responsive to the indication of anticipated power load, calculated from a ratio reflecting the adjustable number of pixels, exceeding a threshold; and a display that displays the composite view.

9. The content display device of claim 8, wherein the display is an OLED display.

10. The content display device of claim 8, including a color table coupled to the selective object adjustment component, the selective object adjustment component darkens the subcomponent with a larger color surface and adjusts the contrast of selected ones of the plurality of subcomponents in accord with permissible background and foreground color-combination data in the color table.

11. The content display device of claim 10, including an ambient light sensor, the ambient light sensor providing ambient light information that is used in combination with the color table to modify an operation of the selective object adjustment component responsive to environmental lighting conditions.

12. A content display device comprising:

means for receiving content that includes a plurality of subcomponents, the plurality of subcomponents including a subcomponent with a larger color surface than other ones of the plurality of subcomponents;

means for rendering each of the plurality of subcomponents;

means for darkening the subcomponent with the larger color surface so as to generate a darkened subcomponent;

means for adjusting a contrast, relative to the darkened subcomponent, of selected ones of the plurality of subcomponents so as to enable the selected ones of the plurality of subcomponents to be viewed against the darkened subcomponent;

means for leaving others of the plurality of subcomponents in their source format;

means for compositing the darkened subcomponent, the selected ones of the plurality of subcomponents, and the others of the plurality of subcomponents that are in their source format into a composite view;

means for determining an entire number of pixels of the composite view;

means for determining a number of pixels of nonadjustable subcomponents so as to obtain a nonadjustable number of pixels;

means for subtracting the nonadjustable number of pixels from the entire number of pixels to obtain a ratio reflecting an adjustable number of pixels; and means for determining an anticipated power load of the adjustable number of pixels, wherein the anticipated power load of the adjustable number of pixels is a power load of the adjustable number of pixels if the adjustable number of pixels were displayed with adjustable subcomponents in their source format;

wherein the means for darkening the subcomponent with the larger color surface and the means for adjusting the contrast of the selected ones of the plurality of subcomponents is responsive to the anticipated power load of the adjustable pixel area exceeding a threshold; and means for displaying the composite view.

13. The content display device of claim 12, wherein the means for darkening the background includes means for inverting the subcomponent with the larger color surface so as to generate the darkened subcomponent, and wherein the means for adjusting a contrast of selected ones of the plurality of subcomponents includes means for inverting the selected ones of the plurality of subcomponents.

14. The content display device of claim 12, wherein the means for darkening includes means for making an adjustment that is selected from the group consisting of means for reducing an intensity, means for selecting a darker color value, and means for reducing a saturation.

15. The content display device of claim 12, including:

a color table including permissible background and foreground color-combination data;

wherein means for darkening the subcomponent with the larger color surface and means for adjusting the contrast of selected ones of the plurality of subcomponents includes means for darkening the subcomponent with the larger color surface and means for adjusting the contrast of selected ones of the plurality of subcomponents in accord with the permissible background and foreground color-combination data.

16. A non-transitory, tangible computer readable storage medium, encoded with processor readable instructions to perform a method for displaying content, the method comprising:

receiving content that includes a plurality of subcomponents, the plurality of subcomponents including a subcomponent with a larger color surface than other ones of the plurality of subcomponents;

rendering each of the plurality of subcomponents;

darkening the subcomponent with the larger color surface so as to generate a darkened subcomponent;

adjusting a contrast, relative to the darkened subcomponent, of selected ones of the plurality of subcomponents so as to enable the selected ones of the plurality of subcomponents to be viewed against the at least one darkened subcomponent;

leaving others of the plurality of subcomponents in their source format;

compositing the at least one darkened subcomponent, the selected ones of the plurality of subcomponents, and the others of the plurality of subcomponents that are in their source format into a composite view;

determining an entire number of pixels of the composite view;

determining a number of pixels of nonadjustable subcomponents so as to obtain a nonadjustable number of pixels;

subtracting the nonadjustable number of pixels from the entire number of pixels to obtain a ratio reflecting an adjustable number of pixels; and determining an anticipated power load of the adjustable number of pixels, wherein the anticipated power load of the adjustable number of pixels is a power load of the adjustable number of pixels if the adjustable number of pixels were displayed with adjustable subcomponents in their source format;

wherein the darkening the subcomponent with the larger color surface and the adjusting the contrast of the selected ones of the plurality of subcomponents is responsive to the anticipated power load of the adjustable number of pixels exceeding a threshold; and displaying the composite view.

17. The non-transitory, tangible computer readable storage medium of claim 16, wherein darkening the background includes inverting the subcomponent with the larger color surface so as to generate the at least one darkened subcomponent, and wherein adjusting a contrast of selected ones of the plurality of subcomponents includes inverting the selected ones of the plurality of subcomponents.

18. The non-transitory, tangible computer readable storage medium of claim 16, wherein darkening includes making an adjustment selected from the group consisting of reducing an intensity, selecting a darker color value, and reducing a saturation.

19. The non-transitory, tangible computer readable storage medium of claim 16, wherein the nonadjustable subcomponents are predetermined to be nonadjustable based upon a type of each of the plurality of subcomponents.

20. The non-transitory, tangible computer readable storage medium of claim 19, wherein the types of subcomponents that are predetermined to be nonadjustable are selected from the group consisting of images, videos, and canvas objects.

21. The non-transitory, tangible computer readable storage medium of claim 20, wherein the nonadjustable subcomponents are slightly adjusted by reducing an intensity or reducing saturation.

22. The non-transitory, tangible computer readable storage medium of claim 16, the method including:

accessing a color table to retrieve permissible background and foreground color-combination data;

wherein darkening the background and adjusting the contrast of selected ones of the plurality of subcomponents includes darkening the background and adjusting the contrast of selected ones of the plurality of subcomponents in accord with the permissible background and foreground color-combination data.

* * * * *